US008512168B2

(12) United States Patent
Hanley

(10) Patent No.: US 8,512,168 B2
(45) Date of Patent: Aug. 20, 2013

(54) GOLF BALL PLACEMENT DEVICE

(76) Inventor: Martin G. Hanley, St. Louis, MO (US)

( * ) Notice: Subject to any disclaimer, the term of this patent is extended or adjusted under 35 U.S.C. 154(b) by 0 days.

(21) Appl. No.: 13/323,334

(22) Filed: Dec. 12, 2011

(65) Prior Publication Data

US 2013/0150187 A1 Jun. 13, 2013

(51) Int. Cl.
*A63B 57/00* (2006.01)

(52) U.S. Cl.
USPC ..... 473/386

(58) Field of Classification Search
USPC ..... 473/386, 387, 132, 133, 408; D21/718, D21/793
See application file for complete search history.

(56) References Cited

U.S. PATENT DOCUMENTS

| | | | | | |
|---|---|---|---|---|---|
| 2,950,110 | A * | 8/1960 | Slotta et al. | 473/386 |
| 3,074,719 | A * | 1/1963 | McKee | 473/386 |
| 3,671,037 | A * | 6/1972 | Murdock, Jr. | 473/386 |
| 3,889,946 | A * | 6/1975 | Setecka | 473/133 |
| 4,660,837 | A * | 4/1987 | Bressie | 473/386 |
| 4,951,947 | A * | 8/1990 | Kopfle | 473/133 |
| 5,310,177 | A * | 5/1994 | Conrad et al. | 473/133 |
| 5,370,388 | A * | 12/1994 | Wehner | 473/386 |
| D386,992 | S * | 12/1997 | Burnett et al. | D10/65 |
| 6,428,429 | B1 * | 8/2002 | Lee | 473/386 |
| 6,949,033 | B1 * | 9/2005 | Mydland | 473/386 |
| 2005/0049085 | A1 * | 3/2005 | Cumisky et al. | 473/386 |
| 2005/0261088 | A1 * | 11/2005 | Suwito | 473/386 |
| 2007/0042839 | A1 * | 2/2007 | Smith et al. | 473/386 |
| 2008/0135444 | A1 * | 6/2008 | Malcom | 473/386 |
| 2009/0017942 | A1 * | 1/2009 | Guldenring | 473/386 |
| 2009/0325734 | A1 * | 12/2009 | Nania et al. | 473/386 |

* cited by examiner

*Primary Examiner* — Steven Wong
(74) *Attorney, Agent, or Firm* — Polster, Lieder, Woodruff & Lucchesi, L.C.

(57) ABSTRACT

A device (10) for inserting a tee (T) into the ground so a golf ball placed on the tee is consistently at a desired height. A post (12) of the device extends vertically when set on the ground and a tee holder (14) fit on the device moves vertically relative to it. A tee is inserted into the holder for insertion into the ground. A stop (16) installed on the post is vertically movable to adjust the depth to which the tee is inserted into the ground. The stop is locked in place once a desired depth is determined and the holder is then pushed down the post until further movement is blocked by the stop. Movement of the holder presses the tee into the ground to the desired depth with a golf ball subsequently set upon the tee now being at a desired height above the ground.

10 Claims, 5 Drawing Sheets

GOLF BALL PLACEMENT DEVICE

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to the playing and practicing of golf; and, more particularly, to a tool or device that enables a golfer to consistently tee his golf ball at a desired height.

Hitting a golf ball, especially off a tee, provides a golfer a particular advantage in that it enables him to place the ball exactly how he wants it so that he can get the most out of the tee shot he then hits. However, if the golfer inconsistently tees his ball so that one time it is higher off the ground then the next time, his results are going to be inconsistent. That is because one time he might hit the ball high on the clubface and the next time low on it. It is well known that the characteristics of ball flight (e.g., trajectory, carry, roll) are to a great degree determined by where the ball is struck. Therefore, there is a need for a device that allows the golfer to tee his ball in the same place every time so that knows, all else about his swing being consistent from one tee shot to the next, what the result of his tee shot will be.

BRIEF SUMMARY OF THE INVENTION

The present disclosure is directed to a tool or device that enables a golfer to consistently tee his golf ball at a desired height. The device is useful both on the course during play and on the range during practice.

The device, which is of a lightweight plastic, has a post, a tee holder movable relative to the post section, and an adjustable stop. Once the golfer decides how high he wishes to tee his ball, he moves the stop to a location on the post of the tool and locks it in place. He then inserts a tee into the tee holder which is then held in place without the user having to keep it there. Next, the golfer places the tip end of the tee in the ground and pushes down on the tee holder. This movement is halted when the tee holder abuts against the stop at which time the tee is inserted in the ground a distance that when a golf ball is set on the tee it is at the desired height.

In addition to setting the tee in the ground, the tool can also be used to repair divots and the like.

The tool is low cost and can be readily carried by the golfer in his pants' pocket or golf bag. The device is readily assembled without the use of tools, is adjustable to allow a golf ball to be teed over a wide range of heights, and reliably inserts a tee into the ground.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

Figures 1, 2, 3, 4, 5, 6, 7, 8:
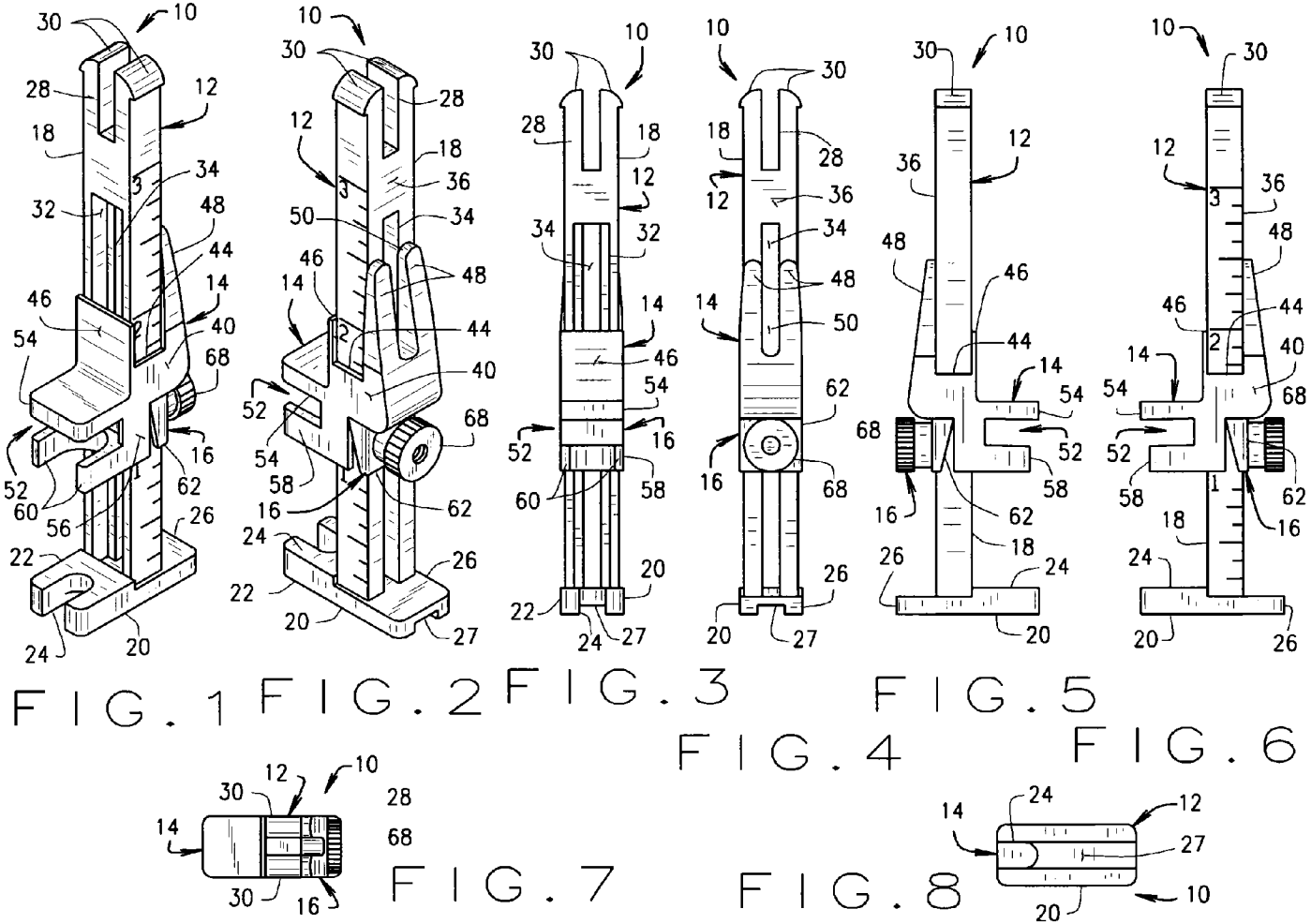
FIGS. 1 and 2 are perspective views of the device of the present invention.
FIGS. 3-6 are side elevation views of respective sides of the device.
FIGS. 7 and 8 are respective top and bottom plan views of the device.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Figure 11:
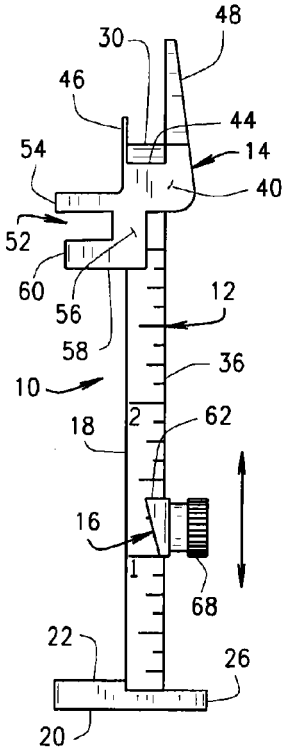
FIGS. 11-13 illustrate use of the device to insert a tee in the ground so a golf ball is teed at a desired height.
Figure 12:
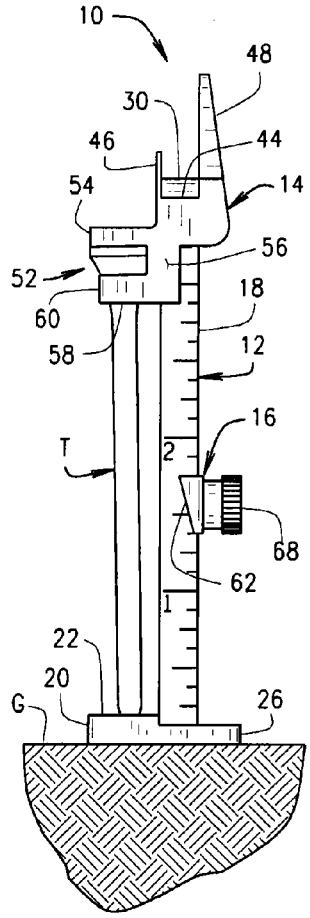
Figure 13:
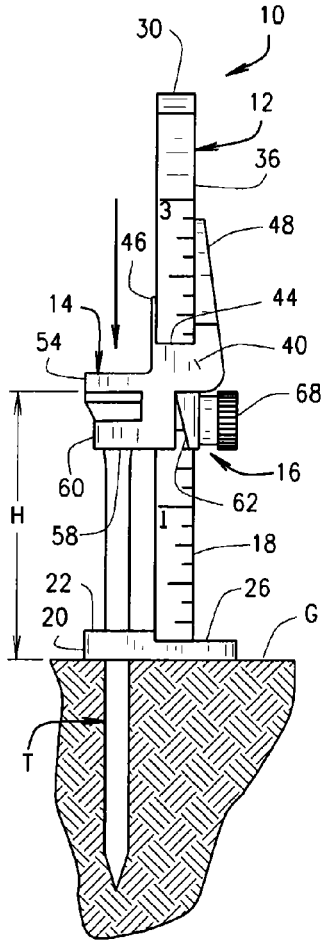

Referring to the drawings, a device or tool 10 of the present invention is for inserting a golf ball tee T into the ground so a golf ball (not shown) is consistently teed at a desired height H above the ground G when placed on the tee. As shown in FIGS. 11-13, device 10 first includes a post 12 which extends vertically when set upon the ground. Next the device includes a tee holder 14 which is installed on post 12 and is vertically movable relative to it. A tee T (see FIG. 12) is then inserted into holder 14 for insertion into the ground as shown in FIG. 13. Finally, a movable stop 16 is also installed on post 12 and is vertically movable relative to the post. Stop 16 is used to adjust the depth to which tee T is inserted in the ground. The stop is locked in place once a desired depth is determined with holder 14 then being pushed down along the length of section 12 until further downward movement is blocked by stop 16. Movement of tee holder 14 presses the pointed end of tee T into the ground to the desired depth so a golf ball (not shown) subsequently set upon the tee is at a desired height H above the ground.

Figure 9:
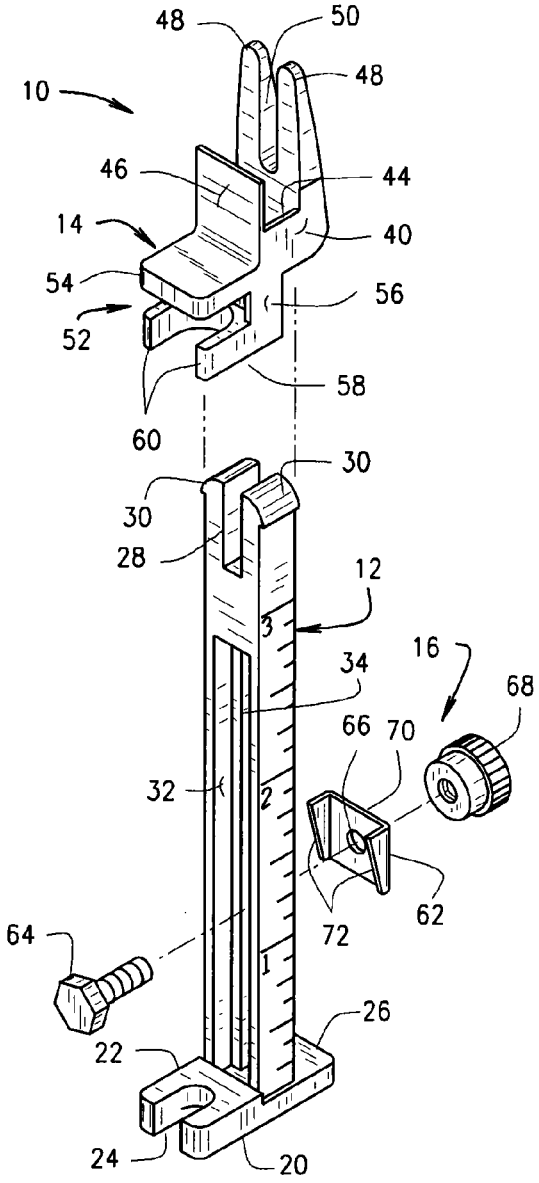
FIGS. 9 and 10 are exploded views illustrating assembly of the device
Figure 14:
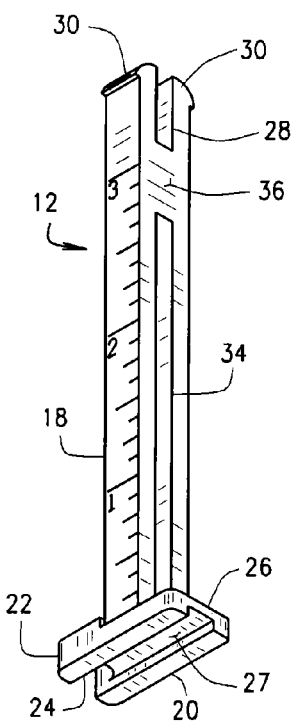
FIG. 14 is perspective view of a post of the device.

Particularly referring to FIGS. 9 and 14, post of device 10 includes a rectangular shaped post 18 which sits atop a rectangular shaped base 20. Base 20 has a front section 22 in which is formed a vertically extending circular slot 24 the diameter of which is slightly greater than the diameter of the shank of tee T for the tee to be pushed through the slot as described hereinafter. A rear section 26 of the base comprises a platform on which the base of post 18 is received. The base supports post 18 in a substantially vertical position. A rectangular shaped slot 27 is formed on the underside of base 20 and extends longitudinally of the base.

Figure 10:
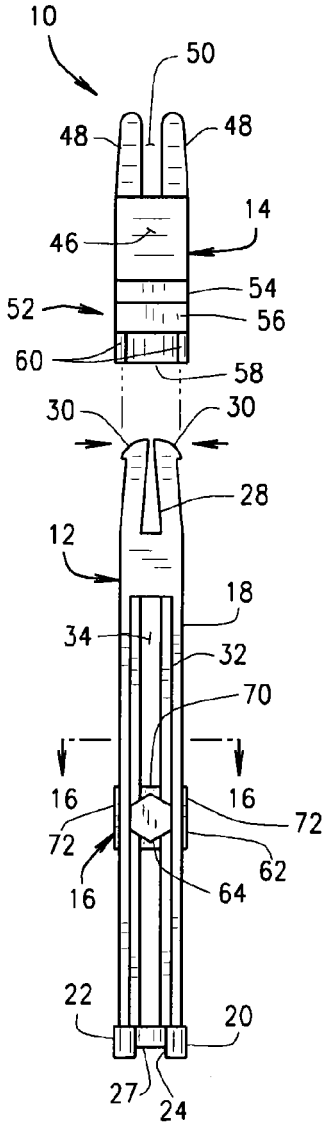

A vertically extending slot 28 extends from the top of post 18 partially along the length of the post. The top of post 18 on either side of the top of slot 28 flares outwardly as indicated at 30. As shown in FIG. 10, slot 28 allows the flared upper ends 30 of post 18 to be pinched together in order to install tee holder 14 of device 10 onto post 18.

A groove 32 is formed in post 18 and extends from a point slightly below the inner end of slot 28 all the way to the base of post 18 which it abuts against base 20. Groove 32 includes a slot 34 extending down a back surface 36 of post 18. Groove 32 and slot 34 allow for both vertical movement of holder 14 of device 10 and the positioning of stop 16 so a tee is pushed in the ground until the height H of the tee remains above the ground.

Figure 15:
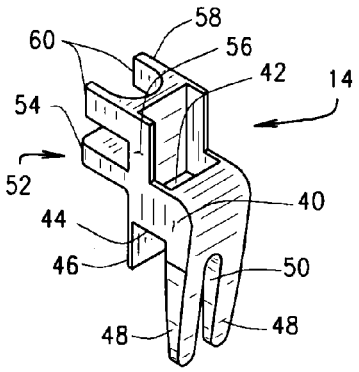
FIG. 15 is a perspective view of a tee holder comprising a tee holder of the device.
Figure 16:
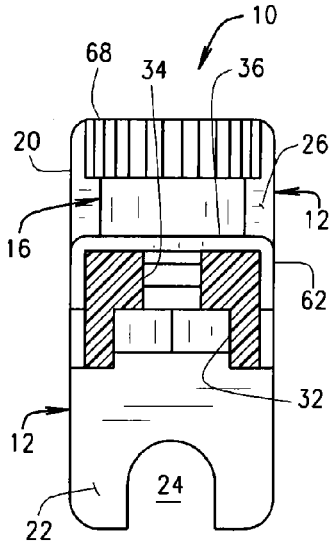
FIG. 16 is a sectional view taken along line 16-16 in FIG. 10.
Figure 17:
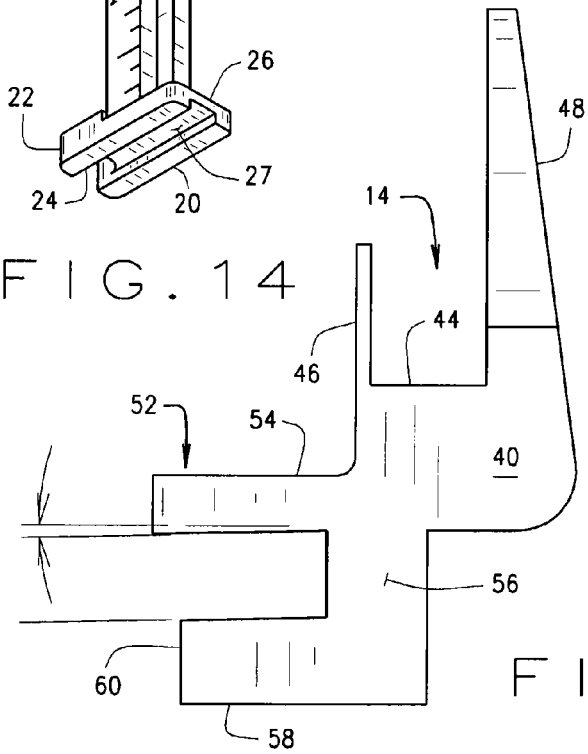
FIG. 17 is side view of the tee holder illustrating an angle formed at the top of the space where a tee is inserted so to better hold the tee in place.

Particularly referring to FIGS. 15 and 17, tee holder 14 is installed on post 18 so to glide up and down on the post in order to insert a tee into the ground. Holder 14 first comprises a horizontal base 40 in which is formed a rectangular shaped opening 42 (see FIG. 15) corresponding in size and shape to post 18 for the holder to be received on and move relative to the post. As previously noted, holder 14 is installed on the post by pinching together the upper ends 30 of post 18 together so that the holder can be inserted on the post with pushing the holder downwardly with the squeezed in upper portion of the post fitting through opening 42 in the holder. After the holder has been pushed sufficiently far down onto the post, the upper ends of the post are released with the curved upper ends 30 of the posts going back to their original positions. In their restored positions, the undersides of the curved ends 30 of post 18, now abut against a shoulder 44 formed along the upper side of base 42 when holder 14 is extended upward along post 18. This abutment prevents holder 18 from being removed from the post and limits the upper extent of the travel of the holder.

Figure 18:
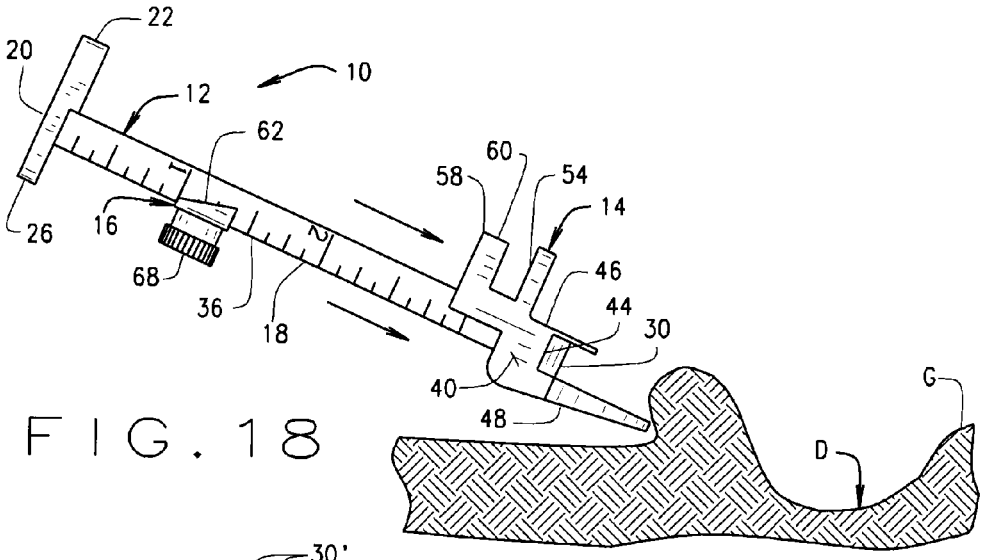
FIG. 18 illustrates use of the device as a divot tool.
Figure 19:
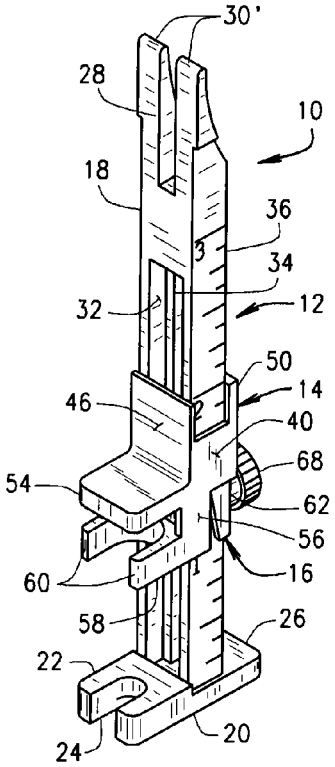
FIGS. 19 and 20 are perspective views of a second embodiment of the devise.
Figure 20:
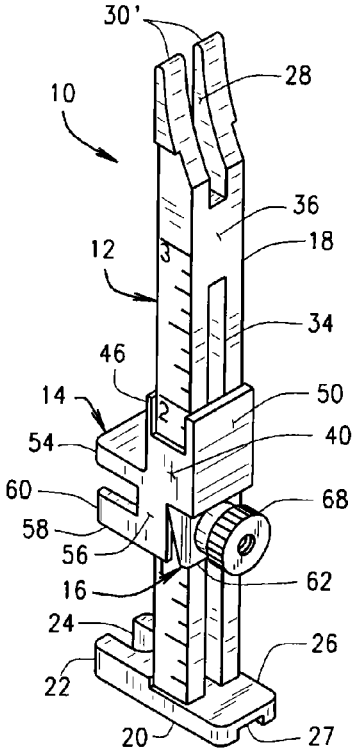

A wall 46, which defines one side of opening 42, projects upwardly from one end of base 40 so to help guide movement of the holder along post 18. On the opposite side of the opening, two prongs 48 extend upwardly, the prongs being divided by a slot 50. The upper ends of the prongs are generally rounded which allows device 10 to be used as a tool for repairing a divot D as shown in FIG. 18. Alternately, and as shown in FIGS. 19 and 20, rather than prongs 48, a wall 50 similar in height to wall 46, is formed on this side of the opening. In this embodiment, upper ends 30 of post 18 are used as a divot repair tool.

Depending from one end of holder base 40 is a seat 52 for holding the upper flared end of tee T. Seat 52 supports this end of the tee while the tip end of the tee is pushed in the ground by pressing on an upper end of the seat. An upper portion of seat 52 comprises a plate 54 which extends forwardly from base 40 and outward from the one side of post 18. Depending from this same end of base 40 is a vertical section 56 at the lower end of which is formed a forwardly extending U-shaped bracket 58. As shown, for example, in FIG. 17, bracket 58 does not extend as far outwardly as plate 54, and the bracket is taller (thicker) than the plate. Also as shown in this Fig., the underside of plate 54 angles slightly downwardly. The distance between the underside of plate 54 and the upper surface of bracket 58 generally corresponds to the thickness (height) of the upper flared portion of the tee on which a golf ball is set after the tee is inserted into the ground. The opening formed in bracket 58 is sized so to receive the upper shank portion of the tee. When the upper end of a tee is inserted into the space between the plate and bracket, the underside of the portion of the tee on which the ball is set is fitted between fingers 60 forming the opening in the bracket and the top of the tee bears against the underside of plate 54. The slight downward angle formed on the underside of the plate is to retain the tee in place once it is fitted into holder 14. When the head of tee T inserted in seat 52, the tee depends from the seat extending generally parallel to post 18.

As shown in the drawings, stop 16 is located below the position of holder 14 on post 18. Referring to FIG. 9, stop 16 is shown to comprise a U-shaped bracket 62, a screw 64 the threaded end of which is insertable through an opening 66 in the bracket, and a knurled knob 68 in which this threaded end of the screw is received. Bracket 62 has a back wall 70 in which opening 66 is formed, and sidewalls 72. The width of the bracket corresponds to that of post 18 with the inner face of the respective sidewalls 72 guiding movement of the bracket along the length of the post. As best shown in FIG. 10, the head of screw 64 is sized to be received in groove 32 so as not to interfere with insertion of tee T into the ground when someone pushes on the top of plate 54 of holder 14 to push the holder down the length of the post. As shown in the drawings, stop 16 is sufficiently adjustable to allow a golf ball to be teed over a wide range of heights.

Prior to insertion of a tee, the golfer first determines the height H to which he wants the T to extend above the ground. He then moves stop 16 to a height corresponding to this height and then locks the stop in place by tightening knob 68. Next he inserts the head of the T in seat 52 of holder 14 and places base 20 of the device on the ground at a desired teeing location. He then pushes against the top of plate 54 forcing holder 18 down along post 18, this action pushing the tip end of the tee into the ground. When the underside of holder base 40 abuts against the top of stop bracket 62, the top of the portion of the tee above the ground is at the desired height H. The golfer then slides the device away from the tee and sets his ball on top of the tee.

Tool 10 is of a low cost plastic material which is small and lightweight enough to be carried by the golfer in his pants' pocket or golf bag. The device is readily assembled without the use of tools.

In view of the above, it will be seen that the several objects and advantages of the present disclosure have been achieved and other advantageous results have been obtained.

The invention claimed is:

1. A device for inserting a tee for a golf ball into the ground so the golf ball is consistently at a desired height above the ground when placed on the tee, comprising:

a post which extends vertically when set upon the ground, the post having a base which is placed upon the ground prior to a tee being installed on the post for the post to rest on the ground during insertion of a tee in the device;

a tee holder installed on the post and vertically movable relative to the post and a tee being inserted onto the tee holder for insertion into the ground; and a movable stop also installed on the post and vertically movable relative to the post, the stop being used to adjust the depth to which the tee is inserted in the ground, the stop being locked in place once a desired depth is determined, the tee holder then being lowered along the length of the post until further movement is blocked by the stop with movement of the tee holder pressing the tee into the ground to the desired depth for subsequent placement of a golf ball upon the tee at a desired height above the ground.

2. The device of claim 1 in which the post has a groove formed therein through which the stop is movable, the stop being locked in a position at a height corresponding to a desired height at which a golfer tees his golf ball.

3. The device of claim 2 in which the stop includes a bracket movable over the outside of the post, a screw which fits through the groove and the bracket, and a knob in which a threaded end of the screw is received for locking the stop in place at a desired location.

4. The device of claim 2 in which the holder has an opening sized for installation of the holder about the post and movement therealong, the holder being positioned on the post above the location of the stop.

5. The device of claim 4 in which the holder includes a seat into which a head of the tee is inserted with a tip end of the tee extending parallel to the post and depending from the seat.

6. The device of claim 5 in which the holder includes a plate forming an upper portion of the seat, a golfer pushes on the top of the plate to move the holder down along the post and push the tip of the tee into the ground.

7. The device of claim 6 in which the stop includes a bracket fitting about the post and locked in place at a desired tee height, abutment of the seat against the bracket stopping movement of the holder.

8. The device of claim 1 in which the holder further includes a pair of prongs which can extend above the top of the post for use of the device as a divot repair tool.

9. The device of claim 1 in which the post has a pair of curved ends formed at the top thereof for use of the device as a divot repair tool.

10. The device of claim 1 which is sized to fit in a golfer's pants' pocket or in a golf bag.

* * * * *